US010478674B2

(12) United States Patent
Bulpett et al.

(10) Patent No.: US 10,478,674 B2
(45) **Date of Patent: *Nov. 19, 2019**

(54) GOLF BALL COMPRISING A VERY-LOW MELT FLOW INNER COVER LAYER COMPOSITION

(71) Applicant: Acushnet Company, Fairhaven, MA (US)

(72) Inventors: David A. Bulpett, Boston, MA (US); Robert Blink, Newport, RI (US); Mark L. Binette, Mattapoisett, MA (US); Brian Comeau, Berkley, MA (US); Michael J. Sullivan, Old Lyme, CT (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,500

(22) Filed: Mar. 27, 2018

(65) Prior Publication Data

US 2018/0214745 A1 Aug. 2, 2018

Related U.S. Application Data

(63) Continuation of application No. 14/799,849, filed on Jul. 15, 2015, now Pat. No. 9,925,417, which is a (Continued)

(51) Int. Cl.

| | |
|---|---|
| ***A63B 37/04*** | (2006.01) |
| ***A63B 37/00*** | (2006.01) |
| ***A63B 37/12*** | (2006.01) |

(52) U.S. Cl.

CPC ..... *A63B 37/0003* (2013.01); *A63B 37/0031* (2013.01); *A63B 37/0033* (2013.01); *A63B 37/0043* (2013.01); *A63B 37/0044* (2013.01); *A63B 37/0045* (2013.01); *A63B 37/0048* (2013.01); *A63B 37/0051* (2013.01); *A63B 37/0062* (2013.01); *A63B 37/0063* (2013.01); *A63B 37/0064* (2013.01); *A63B 37/0075* (2013.01); *A63B 37/0076* (2013.01); *A63B 37/0087* (2013.01); *A63B 37/0092* (2013.01); *A63B 37/12* (2013.01); *A63B 2037/0079* (2013.01)

(58) Field of Classification Search

CPC ..... A63B 37/0003
USPC ..... 473/370, 374, 376
See application file for complete search history.

(56) References Cited

U.S. PATENT DOCUMENTS

| | | | |
|---|---|---|---|
| 2,998,977 | A | 9/1961 | Molitor et al. |
| 4,650,193 | A | 3/1987 | Molitor et al. |

(Continued)

*Primary Examiner* — Eugene L Kim
*Assistant Examiner* — Matthew B Stanczak
(74) *Attorney, Agent, or Firm* — Madi B. Milbank

(57) ABSTRACT

A golf ball including a core; an inner cover layer formed from a thermoplastic composition and having a thickness of about 0.005 inches to 0.40 inches and a surface hardness of about 60 Shore D or greater; and an outer cover layer formed from a thermoset material and having a thickness of about 0.01 inches to 0.05 inches and a surface hardness of about 60 Shore D or less. The thermoplastic composition has a first melt flow index at 280° C. under a 10-kg load of less than about 35 g/10 min and a second melt flow index at 265° C. under a 5-kg load of less than about 10 g/10 min.

16 Claims, 1 Drawing Sheet

Related U.S. Application Data continuation of application No. 13/633,180, filed on Oct. 2, 2012, now Pat. No. 9,084,916, which is a continuation-in-part of application No. 12/469,381, filed on May 20, 2009, now Pat. No. 8,337,331.

(56) References Cited

U.S. PATENT DOCUMENTS 4,781,383 A 11/1988 Kamada et al.
4,858,924 A 8/1989 Saito et al.
5,002,281 A 3/1991 Nakahara et al.
5,033,748 A 7/1991 Ebisuno
5,048,838 A 9/1991 Chikaraishi et al.
5,104,126 A 4/1992 Gentiluomo
5,312,857 A * 5/1994 Sullivan ..... C08K 5/098 273/DIG. 22
5,314,187 A 5/1994 Proudfit
5,482,285 A 1/1996 Yabuki et al.
5,490,674 A 2/1996 Hamada et al.
5,733,206 A 3/1998 Nesbitt et al.
5,743,816 A 4/1998 Ohsumi et al.
5,772,531 A 6/1998 Ohsumi et al.
5,779,562 A 7/1998 Melvin et al.
5,820,489 A * 10/1998 Sullivan ..... A63B 37/0003 473/377
5,873,796 A 2/1999 Cavallaro et al.
5,891,973 A 4/1999 Sullivan et al.
5,976,443 A * 11/1999 Nesbitt ..... A63B 37/0003 264/250
6,057,403 A 5/2000 Sullivan et al.
6,071,201 A 6/2000 Maruko
6,113,831 A 9/2000 Nesbitt et al.
6,213,895 B1 4/2001 Sullivan et al.
6,245,859 B1 6/2001 Sullivan et al.
6,277,034 B1 8/2001 Nesbitt et al.
6,303,704 B1 10/2001 Nesbitt
6,336,872 B1 1/2002 Moriyama et al.
6,350,793 B1 2/2002 Kennedy, III et al.
6,379,269 B1 4/2002 Nesbitt et al.
6,394,912 B1 5/2002 Nakamura et al.
6,406,383 B2 6/2002 Moriyama et al.
6,431,998 B1 8/2002 Nakamura et al.
6,432,342 B1 8/2002 Nesbitt et al.
6,478,695 B1 * 11/2002 Inoue ..... A63B 37/0003 473/371
6,500,076 B1 12/2002 Morgan et al.
6,569,036 B1 5/2003 Takemura et al.
6,605,009 B1 8/2003 Nakamura et al.
6,616,550 B2 9/2003 Nesbitt et al.
6,626,770 B2 9/2003 Takemura et al.
6,777,472 B1 8/2004 Statz et al.
6,815,521 B2 11/2004 Iwami
6,852,044 B2 2/2005 Sullivan et al.
6,855,074 B2 2/2005 Kato
6,913,548 B2 7/2005 Moriyama et al.
6,916,254 B2 7/2005 Ladd et al.
6,981,926 B2 1/2006 Sullivan et al.
6,988,962 B2 1/2006 Sullivan et al.
7,037,965 B2 5/2006 Sullivan et al.
7,074,137 B2 7/2006 Sullivan et al.
7,125,345 B2 10/2006 Sullivan et al.
7,144,958 B2 * 12/2006 Chen ..... A63B 37/0003 525/183
7,153,467 B2 12/2006 Brum et al.
7,238,737 B2 * 7/2007 Chen ..... A63B 37/0003 473/371
7,255,656 B2 8/2007 Sullivan et al.
7,429,624 B2 * 9/2008 Chen ..... A63B 37/0003 473/329
7,935,759 B2 * 5/2011 Sullivan ..... A63B 37/0003 473/373
8,337,331 B2 * 12/2012 Bulpett ..... A63B 37/0003 473/376
9,084,916 B2 * 7/2015 Bulpett ..... A63B 37/0003
9,925,417 B2 * 3/2018 Bulpett ..... A63B 37/0003
2003/0109331 A1 6/2003 Sullivan et al.
2004/0235586 A1 * 11/2004 Chen ..... A63B 37/0003 473/351
2006/0128904 A1 6/2006 Sullivan et al.
2009/0011858 A1 * 1/2009 Binette ..... A63B 37/0003 473/373
2009/0227394 A1 * 9/2009 Bulpett ..... A63B 37/0003 473/373
2009/0280928 A1 * 11/2009 Comeau ..... A63B 37/0003 473/374
2010/0035705 A1 * 2/2010 Melanson ..... B29C 71/04 473/378
2011/0244982 A1 * 10/2011 Harris ..... A63B 37/0003 473/371

* cited by examiner

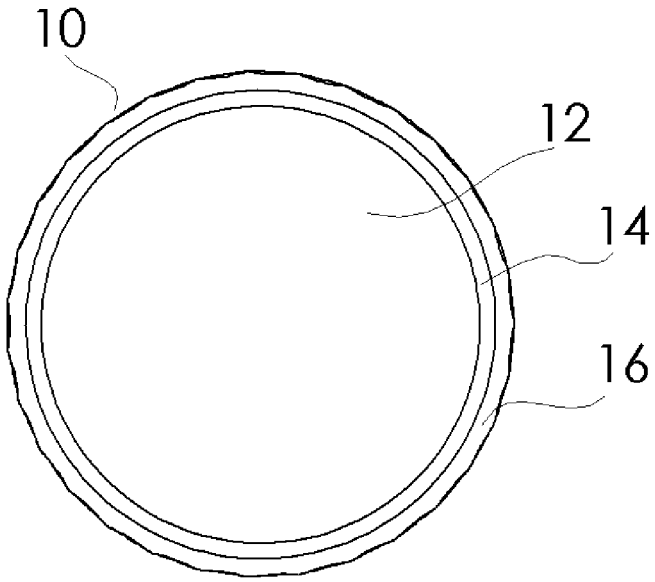
10
12
14
16

GOLF BALL COMPRISING A VERY-LOW MELT FLOW INNER COVER LAYER COMPOSITION

CROSS-REFERENCE TO RELATED APPLICATIONS

This application is a continuation of co-pending U.S. patent application Ser. No. 14/799,849, filed Jul. 15, 2015, which is a continuation of U.S. patent application Ser. No. 13/633,180, filed Oct. 2, 2012 and now U.S. Pat. No. 9,084,916, which is a continuation-in-part of U.S. patent application Ser. No. 12/469,381, filed May 20, 2009 and now U.S. Pat. No. 8,337,331, the disclosures of which are incorporated herein by express reference thereto.

FIELD OF THE INVENTION

The present invention generally relates to golf balls, and more particularly to golf balls having multi-layer covers comprising a thermoplastic inner cover layer, and a thermoset outer core layer.

BACKGROUND OF THE INVENTION

Golf balls having multi-cover layers are known as is the use of ionomers and highly neutralized polymers as cover layers. Several patents and published applications in the prior art teach that it is essential for cover materials to have good flow properties, in particular they should have a high melt flow rate as demonstrated by having a high Melt Flow Index (MFI). For example, U.S. Pat. No. 7,572,195 to Egashira et al., U.S. Pub. Appl. No. 2010/0167841 to Okabe et al., and U.S. Patent Application Serial No. 2010/0190580 to Higuchi et al. all teach compositions for use as golf ball inner cover layers that have MFI's of greater than 2. Other references such as U.S. Patent Application Serial Nos. 2010/0069173 to Okabe et al. and 2010/0075777 to Shigemitsu et al. teach compositions for use as golf ball inner cover layers that are blends of low MFI materials and high MFI materials. Other references teach a broad range of MFI, such as U.S. Patent Application Serial No. 2011/0092312 to Shigemitsu, but only measured at a relatively low temperature, 190° C., and are silent as to the need for the material to be low melt flow at the higher temperatures at which inner cover leakage may occur.

Generally, golf ball cover layers are formed from thermoplastic and/or thermoset compositions. The present invention, however, provides a novel multi-cover layer golf ball construction wherein an inner cover comprises a very low melt flow thermoplastic, and an outer cover layer comprises a thermoset or thermoplastic composition. A problem with molding a thermosetting composition requiring an elevated temperature and/or pressure to cure, over a higher melt flow thermoplastic composition such as an ionomer, is that the ionomer tends to flow out or "leak" out through the thermosetting layer during overmolding—in general, there exist tremendous difficulties in molding high-temperature thermoset materials over any soft layer. The invention herein seeks to reduce or eliminate "leakage" by either 1) reducing the melt flow of the ionomeric material or 2) otherwise increasing the heat resistance of the ionomer by modifying either the ionomeric resin itself prior to molding or via a post-mold treatment to the ionomeric golf ball layer.

Ionomeric materials have long been used as layers of golf balls, very commonly as inner or outer cover layers. Ionomers have excellent toughness, crack resistance, resilience, and a wide range of hardness values and moduli, which make them ideally suited for these types of layers. Methods have been developed to compression or injection mold ionomers into golf ball layers-such methods involve heating the materials to soften and melt them thereby promoting flow to form the desired layers. Ionomers have relatively low vicat softening points (47-71° C.) and low melting temperatures (70-96° C.) which makes them readily moldable but also gives them inherently low resistance to heat and very poor high-temperature properties. As such, the inventive thermoplastic inner cover layers attempt to make use of materials having very low flow at elevated temperatures and/or high resistance to heat.

Most ionomers suitable for conventional golf ball layers have a percent neutralization of from 19 wt % to 69 wt %. Higher levels of neutralization have previously been unsuitable for use by manufacturers or disclosed in the prior art as being useful, without addition of high levels of metal cation-fatty acid flow modifiers, due to the difficulty of molding more highly-neutralized ionomers (>70 wt % neutralization). Whereas the conventional low-neutralization (19-69 wt %) ionomers may be easily injection molded at temperatures of about 300° F. (149° C.) to 450° (232° C.), the highly-neutralized and/or treated ionomers of the invention must be molded at elevated temperatures of from about 500° F. (260° C.) to 680° F. (360° C.) and, more preferably, about 550° F. (288° C.) to 650° F. (343° C.), temperatures previously thought undesirable. When compression molding conventional ionomers (using a two-step process in which half shells are first injection molded, then placed around a core and compression molded into a ball) temperatures as low as 250° F. (121° C.) and typically from about 250° F. (121° C.) to 350° F. (177°) are used. The inventive ionomers must be processed at temps well above 350° F. (177° C.).

The inventive constructions herein (i.e., thermoset or thermoplastic outer cover layers molded over a thermoplastic ionomeric layer) additionally involve the molding of a material requiring curing or processing at a temperature well above the softening and melting temperature of conventional ionomers. This presents a problem that the invention herein seeks to solve, that is, provide ionomeric compositions that will not significantly soften and flow at the conditions that occur when overmolding with a material that requires elevated temperatures to form said overmolded layer.

Commercially ionomers are available in a wide range of melt flows, the melt flow being determined by the degree of neutralization of the acid moiety of the acid copolymer with various metal cations, optimized for physical properties such as toughness and elongation while maintaining melt-processability. Neutralization to 90% and higher is known but is not considered a commercially-viable and usable product because of the loss of melt-processability (producing a low melt flow or intractable material), particularly for copolymers with high acid levels. For example, U.S. Pat. No. 6,777,472 generally describes a process for modification of highly-neutralized ionomers by the addition of a sufficient amount of specific organic fatty acids (or metal salts thereof) in order to maintain melt-processability—unmodified, highly-neutralized ionomers are typically considered unworkable materials because of their low-melt-flow properties.

Various methods of covalent crosslinking the outermost cover of golf balls are known. For example, U.S. Pat. No. 5,891,973 generally discloses an ionomer-covered golf ball that is irradiated via electron beam exposure to increase the resistance to scuff and cut resistance when impacted with a golf club. Covalent crosslinking of non-ionomeric golf ball cover materials with the addition of peroxide is generally disclosed in U.S. Pat. No. 6,303,704 which is also aimed at improving the scuff and cut resistance of softer covers. Ionomer outermost covers, particularly low modulus ionomers are susceptible to softening when exposed to elevated temperatures, thereby losing dimple definition and negatively impacting aerodynamic properties of the ball. One method to overcome this drawback is the irradiation via electron beam or exposure of the dimpled golf ball to gamma radiation, which is generally disclosed in U.S. Pat. No. 6,350,793. None of these references, however, disclose using novel low-melt-flow (or altered, temperature resistant) thermoplastics as a core layer sandwiched between two, thermosetting rubber core layers.

There remains a need, therefore, for low melt flow and/or high temperature resistant thermoplastic ionomeric materials for use in the novel multi-layer golf ball covers herein. The use of these compositions significantly reduces or eliminates the "leakage" of the ionomeric layer into or through the outer core layer, thereby giving a ball having improved consistency of properties as well as improved durability and much reduced susceptibility to breakage when struck with a club head.

SUMMARY OF THE INVENTION

The present invention is directed to a golf ball having a core, an inner cover layer, and an outer cover layer. The inner cover layer is formed from a thermoplastic composition and has a thickness of about 0.005 to 0.40 inches and a surface hardness of about 60 Shore D or greater. The outer cover layer is formed from a thermoset material and has a thickness of about 0.01 to 0.05 inches and a surface hardness of about 60 Shore D or less. The thermoplastic composition has a first melt flow index at 280° C. under a 10-kg load of less than about 35 g/10 min and a second melt flow index at 265° C. under a 5-kg load of less than about 10 g/10 min.

The first melt flow index is about 20 g/10 min or less, preferably about 10 g/10 min or less. The second melt flow index is about 5 g/10 min or less. In another embodiment, the thermoplastic composition has a third melt flow index at 190° C. under a 2.16-kg load of less than about 2 g/10 min, more preferably less than about 1 g/10 min. The thermoplastic composition may include an ionomer. The ionomer is typically neutralized by a metal cation to 70 wt. % or greater, more preferably 80 wt. % or greater, most preferably 90 wt. % or greater. The thermoplastic composition may include an amine or a peroxide compound, be treated with radiation, or include an ionomer and a higher-melting-temperature thermoplastic resin. The thermoplastic composition may alternatively include an ionomer and a reactive polymer. The core may also be a 'dual core', including an inner core and an outer core layer.

The present invention is also directed to a golf ball formed from a core, an inner cover, and an outer cover. The inner cover layer may be formed from a first thermoplastic composition and has a thickness of about 0.005 to 0.10 inches and a surface hardness of about 60 Shore D or greater. The outer cover layer is formed from a second thermoplastic composition and has a thickness of about 0.01 to 0.05 inches and a surface hardness of about 60 Shore D or less. The first thermoplastic composition preferably has a first melt flow index at 280° C. under a 10-kg load of less than about 35 g/10 min and a second melt flow index at 265° C. under a 5-kg load of less than about 10 g/10 min. In a preferred embodiment, the first and second melt flow indices are less than the melt flow index of the second thermoplastic composition.

BRIEF DESCRIPTION OF THE DRAWINGS

These and other aspects of the present invention may be more fully understood with reference to, but not limited by, the following drawings:

FIG. 1 is a representative cross-section of a golf ball of the invention.

DETAILED DESCRIPTION OF THE INVENTION

A golf ball having a core and a multi-layer cover enclosing the core is disclosed. The core generally comprises a thermosetting rubber single or multiple layer core, and may further comprise a thermoplastic inner, intermediate, or outer core layer. The inner, intermediate, and/or outer core layers may be formed of more than one layer. The multi-layer core has an overall outer diameter within a range having a lower limit of 1.000 or 1.300 or 1.400 or 1.500 or 1.600 or 1.610 inches and an upper limit of 1.620 or 1.630 or 1.640 inches. In a particular embodiment, the single or multi-layer core has an overall outer diameter of 1.500 inches or 1.510 inches or 1.530 inches or 1.550 inches or 1.570 inches or 1.580 inches or 1.590 inches or 1.600 inches or 1.610 inches or 1.620 inches.

In one preferred embodiment, the core consists of a single layer formed from a thermoset rubber composition. In another embodiment, the center and/or outer core layer consists of two layers, each of which is formed from the same or different thermoset rubber compositions.

Suitable rubber compositions for forming the core layer comprise a base rubber, an initiator agent, a co-agent, and optionally one or more of a zinc oxide, zinc stearate or stearic acid, antioxidant, and a soft-and-fast agent. Suitable base rubbers include natural and synthetic rubbers including, but not limited to, polybutadiene, polyisoprene, ethylene propylene rubber ("EPR"), styrene-butadiene rubber, styrenic block copolymer rubbers (such as "SI", "SIS", "SB", "SBS", "SIBS", and the like, where "S" is styrene, "I" is isobutylene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and p-alkylstyrene, halogenated copolymers of isobutylene and p-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof. Diene rubbers are preferred, particularly polybutadiene, styrene-butadiene, and mixtures of polybutadiene with other elastomers wherein the amount of polybutadiene present is at least 40 wt % based on the total polymeric weight of the mixture. Particularly preferred polybutadienes include high-cis neodymium-catalyzed polybutadienes and cobalt-, nickel-, or lithium-catalyzed polybutadienes. Suitable examples of commercially-available polybutadienes include, but are not limited to, BUNA CB high-cis neodymium-catalyzed polybutadiene rubbers, such as BUNA CB 23, and TAKTENE high-cis cobalt-catalyzed polybutadiene rubbers, such as TAKTENE 220 and 221 from Lanxess Corp.; SE BR-1220 from Dow Chemical Company; EUROPRENE NEOCIS BR 40 and BR 60 from Polimeri Europa; UBEPOL-BR rubbers from UBE Industries, Inc.;

BR 01 from Japan Synthetic Rubber Co., Ltd.; and NEODENE high-cis neodymium-catalyzed polybutadiene rubbers, such as NEODENE BR 40 from Karbochem.

Suitable initiator agents include organic peroxides, high energy radiation sources capable of generating free radicals, and combinations thereof. High energy radiation sources capable of generating free radicals include, but are not limited to, electron beams, ultra-violet radiation, gamma radiation, X-ray radiation, infrared radiation, heat, and combinations thereof.

Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butylperoxyisopropyl)benzene; dilauroyl peroxide; dibenzoyl peroxide; t-butyl hydroperoxide; lauryl peroxide; benzoyl peroxide; and combinations thereof. Examples of suitable commercially-available peroxides include, but are not limited to PERKADOX BC dicumyl peroxide from Akzo Nobel, and VAROX peroxides, such as VAROX ANS benzoyl peroxide and VAROX 231 1,1-di(t-butylperoxy)3,3,5-trimethylcyclohexane from RT Vanderbilt Company, Inc. Peroxide initiator agents are generally present in the rubber composition in an amount of at least 0.05 parts by weight per 100 parts of the base rubber, or an amount within the range having a lower limit of 0.05 parts or 0.1 parts or 0.8 parts or 1 part or 1.25 parts or 1.5 parts by weight per 100 parts of the base rubber, and an upper limit of 2.5 parts or 3 parts or 5 parts or 6 parts or 10 parts or 15 parts by weight per 100 parts of the base rubber.

Co-agents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the co-agent is selected from zinc salts of acrylates, diacrylates, methacrylates, dimethacrylates, and mixtures thereof. In another particular embodiment, the coagent is zinc diacrylate. When the co-agent is zinc diacrylate and/or zinc dimethacrylate, the co-agent is typically included in the rubber composition in an amount within the range having a lower limit of 1 or 5 or 10 or 15 or 19 or 20 parts by weight per 100 parts of the base rubber, and an upper limit of 24 or 25 or 30 or 35 or 40 or 45 or 50 or 60 parts by weight per 100 parts of the base rubber. When one or more less active co-agents are used, such as zinc monomethacrylate and various liquid acrylates and methacrylates, the amount of less active coagent used may be the same as or higher than for zinc diacrylate and zinc dimethacrylate co-agents. The desired compression may be obtained by adjusting the amount of crosslinking, which can be achieved, for example, by altering the type and amount of co-agent.

The rubber composition optionally includes a curing agent. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may contain one or more fillers to adjust the density and/or specific gravity of the core. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers and combinations thereof. The amount of particulate material(s) present in the rubber composition is typically within a range having a lower limit of 5 parts or 10 parts by weight per 100 parts of the base rubber, and an upper limit of 30 parts or 50 parts or 100 parts by weight per 100 parts of the base rubber. Filler materials may be dual-functional fillers, such as zinc oxide (which may be used as a filler/acid scavenger) and titanium dioxide (which may be used as a filler/brightener material).

The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like. The amount of additive(s) typically present in the rubber composition is typically within a range having a lower limit of 0 parts by weight per 100 parts of the base rubber, and an upper limit of 20 parts or 50 parts or 100 parts or 150 parts by weight per 100 parts of the base rubber.

The rubber composition optionally includes a soft-and-fast agent. Preferably, the rubber composition contains from 0.05 phr to 10.0 phr of a soft-and-fast agent. In one embodiment, the soft-and-fast agent is present in an amount within a range having a lower limit of 0.05 or 0.1 or 0.2 or 0.5 phr and an upper limit of 1.0 or 2.0 or 3.0 or 5.0 phr. In another embodiment, the soft-and-fast agent is present in an amount of from 2.0 phr to 5.0 phr, or from 2.35 phr to 4.0 phr, or from 2.35 phr to 3.0 phr. In an alternative high concentration embodiment, the soft-and-fast agent is present in an amount of from 5.0 phr to 10.0 phr, or from 6.0 phr to 9.0 phr, or from 7.0 phr to 8.0 phr. In another embodiment, the soft-and-fast agent is present in an amount of 2.6 phr.

Suitable soft-and-fast agents include, but are not limited to, organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof.

As used herein, "organosulfur compound" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Particularly suitable as soft-and-fast agents are organosulfur compounds having the following general formula:

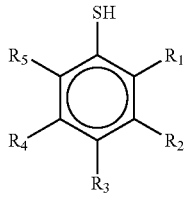

where $R_1$-$R_5$ can be $C_{1-8}$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; zinc salts thereof; non-metal salts thereof, for example, ammonium salt of pentachlorothiophenol; magnesium pentachlorothiophenol; cobalt pentachlorothiophenol; and combinations thereof. Preferably, the halogenated thiophenol compound is pentachlorothiophenol, which is commercially available in neat form or under the tradename STRUKTOL, a clay-based carrier containing the sulfur compound pentachlorothiophenol loaded at 45 percent (correlating to 2.4 parts PCTP). STRUKTOL is commercially available from Struktol Company of America of Stow, Ohio. PCTP is commercially available in neat form and in the salt form from eChinachem of San Francisco, Calif. Most preferably, the halogenated thiophenol compound is the zinc salt of pentachlorothiophenol.

Suitable metal-containing organosulfur compounds include, but are not limited to, cadmium, copper, lead, and tellurium analogs of diethyldithiocarbamate, diamyldithiocarbamate, and dimethyldithiocarbamate, and combinations thereof.

Suitable disulfides include, but are not limited to, 4,4'-diphenyl disulfide; 4,4'-ditolyl disulfide; 2,2'-benzamido diphenyl disulfide; bis(2-aminophenyl) disulfide; bis(4-aminophenyl) disulfide; bis(3-aminophenyl) disulfide; 2,2'-bis(4-aminonaphthyl) disulfide; 2,2'-bis(3-aminonaphthyl) disulfide; 2,2'-bis(4-aminonaphthyl) disulfide; 2,2'-bis(5-aminonaphthyl) disulfide; 2,2'-bis(6-aminonaphthyl) disulfide; 2,2'-bis(7-aminonaphthyl) disulfide; 2,2'-bis(8-aminonaphthyl) disulfide; 1,1'-bis(2-aminonaphthyl) disulfide; 1,1'-bis(3-aminonaphthyl) disulfide; 1,1'-bis(3-aminonaphthyl) disulfide; 1,1'-bis(4-aminonaphthyl) disulfide; 1,1'-bis(5-aminonaphthyl) disulfide; 1,1'-bis(6-aminonaphthyl) disulfide; 1,1'-bis(7-aminonaphthyl) disulfide; 1,1'-bis(8-aminonaphthyl) disulfide; 1,2'-diamino-1,2'-dithiodinaphthalene; 2,3'-diamino-1,2'-dithiodinaphthalene; bis(4-chlorophenyl) disulfide; bis(2-chlorophenyl) disulfide; bis(3-chlorophenyl) disulfide; bis(4-bromophenyl) disulfide; bis(2-bromophenyl) disulfide; bis(3-bromophenyl) disulfide; bis(4-fluorophenyl) disulfide; bis(4-iodophenyl) disulfide; bis(2,5-dichlorophenyl) disulfide; bis(3,5-dichlorophenyl) disulfide; bis(2,4-dichlorophenyl) disulfide; bis(2,6-dichlorophenyl) disulfide; bis(2,5-dibromophenyl) disulfide; bis(3,5-dibromophenyl) disulfide; bis(2-chloro-5-bromophenyl) disulfide; bis(2,4,6-trichlorophenyl) disulfide; bis(2,3,4,5,6-pentachlorophenyl) disulfide; bis(4-cyanophenyl) disulfide; bis (2-cyanophenyl) disulfide; bis(4-nitrophenyl) disulfide; bis (2-nitrophenyl) disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl) disulfide; bis(2-acetylphenyl) disulfide; bis(4-formylphenyl) disulfide; bis(4-carbamoylphenyl) disulfide; 1,1'-dinaphthyl disulfide; 2,2'-dinaphthyl disulfide; 1,2'-dinaphthyl disulfide; 2,2'-bis(1-chlorodinaphthyl) disulfide; 2,2'-bis(1-bromonaphthyl) disulfide; 1,1'-bis(2-chloronaphthyl) disulfide; 2,2'-bis(1-cyanonaphthyl) disulfide; 2,2'-bis(1-acetylnaphthyl) disulfide; and the like; and combinations thereof.

Suitable inorganic sulfide compounds include, but are not limited to, titanium sulfide, manganese sulfide, and sulfide analogs of iron, calcium, cobalt, molybdenum, tungsten, copper, selenium, yttrium, zinc, tin, and bismuth.

Suitable Group VIA compounds include, but are not limited to, elemental sulfur and polymeric sulfur, such as those from Elastochem, Inc. of Chardon, Ohio; sulfur catalyst compounds which include PB(RM-S)-80 elemental sulfur and PB(CRST)-65 polymeric sulfur, each of which is available from Elastochem, Inc; tellurium catalysts, such as TELLOY, and selenium catalysts, such as VANDEX, from RT Vanderbilt Company, Inc.

Suitable substituted and unsubstituted aromatic organic components that do not include sulfur or a metal include, but are not limited to, 4,4'-diphenyl acetylene, azobenzene, and combinations thereof. The aromatic organic group preferably ranges in size from $C_{6-20}$, more preferably from $C_{6-10}$.

Suitable substituted and unsubstituted aromatic organometallic compounds include, but are not limited to, those having the formula $(R_1)_x$—$R_3$-M-$R_4$—$R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_{6-24}$ aromatic group; x and y are each an integer from 0 to 5; $R_3$ and $R_4$ are each selected from a single, multiple, or fused ring $C_{6-24}$ aromatic group; and M includes an azo group or a metal component.

Preferably, $R_3$ and $R_4$ are each selected from a $C_{6-10}$ aromatic group, more preferably selected from phenyl, benzyl, naphthyl, benzamido, and benzothiazyl. Preferably $R_1$ and $R_2$ are each selected from substituted and unsubstituted $C_{1-10}$ linear, branched, and cyclic alkyl, alkoxy, and alkylthio groups, and $C_{6-10}$ aromatic groups. When $R_1$, $R_2$, $R_3$, and $R_4$ are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl and sulfonamide; and phosphates and phosphites. When M is a metal component, it may be any suitable elemental metal. The metal is generally a transition metal, and is preferably tellurium or selenium.

Suitable hydroquinones include, but are not limited to, compounds represented by the following formula, and hydrates thereof:

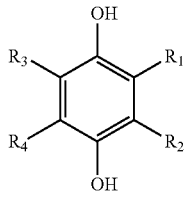

where each of $R_1$, $R_2$, $R_3$, and $R_4$ is independently selected from hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group (e.g., cumyl (—$C(CH_3)_2$—$C_6H_6$) or benzyl (—$CH_2$—$C_6H_6$)), a nitroso group (—NO), an acetamido group (—$NHCOCH_3$), and a vinyl group (—CH═$CH_2$). Particularly preferred hydroquinones include compounds represented by the above formula, and hydrates thereof, wherein each of $R_1$, $R_2$, $R_3$, and $R_4$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group (e.g., cumyl (—$C(CH_3)_2$—$C_6H_6$) or benzyl (—$CH_2$—$C_6H_6$)), a nitroso group (—NO), an acetamido group (—$NHCOCH_3$), and a vinyl group (—CH═$CH_2$). Examples of particularly suitable hydroquinones include, but are not limited to, hydroquionone; tetrachlorohydroquinone; 2-chlorohydroquionone; 2-bromohydroquinone; 2,5-dichlorohydroquinone; 2,5-dibromohydroquinone; tetrabromohydroquinone; 2-methylhydroquinone; 2-t-butylhydroquinone; 2,5-di-t-amylhydroquinone; and 2-(2-chlorophenyl)hydroquinone hydrate. Hydroquinone and tetrachlorohydroquinone are particularly preferred, and even more particularly preferred is 2-(2-chlorophenyl)hydroquinone hydrate.

Suitable benzoquinones include, but are not limited to, compounds represented by the following formula, and hydrates thereof:

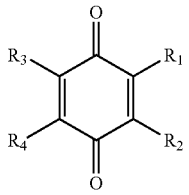

where each of $R_1$, $R_2$, $R_3$, and $R_4$ is independently selected from the ligands disclosed above for the hydroquinones. Particularly preferred benzoquinones include compounds represented by the above formula, and hydrates thereof, where each of $R_1$, $R_2$, $R_3$, and $R_4$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group (e.g., cumyl (—$C(CH_3)_2$—$C_6H_6$) or benzyl (—$CH_2$—$C_6H_6$)), a nitroso group (—NO), an acetamido group (—$NHCOCH_3$), and a vinyl group (—CH═$CH_2$). Methyl p-benzoquinone and tetrachloro p-benzoquinone are more particularly preferred.

Suitable quinhydrones include, but are not limited to, compounds represented by the following formula, and hydrates thereof:

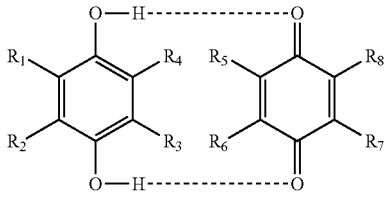

where each of $R_1$, $R_2$, $R_3$, $R_4$, $R_5$, $R_6$, $R_7$, and $R_8$ is independently selected from the ligands disclosed above for the hydroquinones and benzoquinones. Particularly preferred quinhydrones include compounds represented by the above formula, and hydrates thereof, wherein each of $R_1$, $R_2$, $R_3$, $R_4$, $R_5$, $R_6$, $R_7$, and $R_8$ is independently selected from a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group (e.g., cumyl (—$C(CH_3)_2$—$C_6H_6$) or benzyl (—$CH_2$—$C_6H_6$)), a nitroso group (—NO), an acetamido group (—$NHCOCH_3$), and a vinyl group (—CH═$CH_2$). Particularly preferred quinhydrones also include compounds represented by the above formula wherein each of $R_1$, $R_2$, $R_3$, $R_4$, $R_5$, $R_6$, $R_7$, and $R_8$ is hydrogen.

Suitable catechols include, but are not limited to, compounds represented by the following formula, and hydrates thereof:

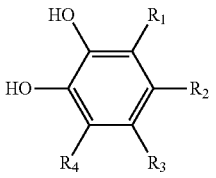

where each of $R_1$, $R_2$, $R_3$, and $R_4$, is independently selected from the ligands disclosed above for the hydroquinones, benzoquinones, and quinhydrones.

Suitable resorcinols include, but are not limited to, compounds represented by the following formula, and hydrates thereof:

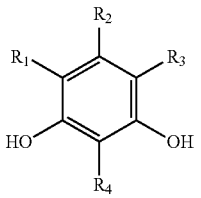

where each of $R_1$, $R_2$, $R_3$, and $R_4$ is independently selected from the ligands disclosed above for the hydroquinones, benzoquinones, quinhydrones, and catechols. 2-Nitroresorcinol is particularly preferred.

When the rubber composition includes one or more hydroquinones, benzoquinones, quinhydrones, catechols, resorcinols, or a combination thereof, the total amount of hydroquinone(s), benzoquinone(s), quinhydrone(s), catechol(s), and/or resorcinol(s) present in the composition is typically at least 0.1 parts by weight or at least 0.15 parts by weight or at least 0.2 parts by weight per 100 parts of the base rubber, or an amount within the range having a lower limit of 0.1 parts or 0.15 parts or 0.25 parts or 0.3 parts or 0.375 parts by weight per 100 parts of the base rubber, and an upper limit of 0.5 parts or 1 part or 1.5 parts or 2 parts or 3 parts by weight per 100 parts of the base rubber.

In a particularly preferred embodiment, the soft-and-fast agent is selected from zinc pentachlorothiophenol, pentachlorothiophenol, ditolyl disulfide, diphenyl disulfide, dixylyl disulfide, 2-nitroresorcinol, and combinations thereof.

Referring to FIG. 1, in one embodiment of the present invention the golf ball 10 includes a core 12, the materials of which are described above, an inner cover layer 14, and an outer cover layer 16.

The inner cover layers of the present invention are formed from a thermoplastic ionomeric material that either 1) has a low melt flow index and/or 2) has an improved heat resistance. Preferably, the thermoplastic, ionomeric compositions are used to form an inner cover layer in a multi-layer cover Improved heat resistance is important to this cover construction, as described in detail in the background section, because the outer cover includes a thermosetting or thermoplastic outer cove layer that must be molded over the ionomeric inner cover layer. When using a conventional ionomeric composition, which has low heat resistance and relatively high melt flow properties, flow-out or leakage of the ionomeric layer into (and possibly through) the over-molded thermoset or thermoplastic layer during compression molding at an elevated temperature and pressure is a problem.

In one embodiment, a reduced melt flow ionomer is made by neutralizing about 70 wt. % or more, 75 wt. % or more, preferably 80 wt. % or more, more preferably at least 90 wt. %, and most preferably at least about 95 wt. % of the acid groups without the use of any "ionic plasticizer" such as the fatty acids or fatty acid salts required to form the highly-neutralized polymers. In a preferred embodiment a high acid ionomer containing 19 wt. % to 20 wt. % methacrylic or acrylic acid is neutralized with a blend of zinc and sodium cations to the 95 wt. % level such that the melt flow of the composition at 190° C. is very low (less than 0.5 g/10 min) and the melt flow at 280° C. is less than about 0.50 g/10 min.

The melt flow indices of the thermoplastic, preferably ionomeric, polymers used to form the inner cover layers of the invention should have a melt flow index, as measured at 280° C. under a mass of 10 kg, of less than about 35 g/10 min, preferably less than about 20 g/10 min, and most preferably less than about 10 g/10 min. In a preferred embodiment, these melt flow indices have concurrent melt flow indices, as measured at 265° C. under a mass of 5 kg, of less than about 10 g/10 min, preferably less than about 5 g/10 min. In a preferred particularly embodiment, both of these melt flow indices further have concurrent melt flow indices, as measured at 190° C. and 230° C. under a mass of 2.16 kg, of less than about 2 g/10 min, preferably less than about 1 g/10 min, more preferably less than about 0.5 g/10 min, and most preferably less than about 0.1 g/10 min.

Other preferred cation sources include lithium, magnesium, manganese, aluminum, potassium, calcium, zirconium, barium, etc. When aluminum is used it is preferably used at low levels with another cation source, such as zinc, sodium, or lithium, since aluminum has a dramatic effect on melt flow reduction and often cannot be used alone at high levels. Very high surface area cation sources, such as micro and nano-scale cation sources, are particularly preferred.

Where processability of such highly-neutralized ionomers may become very difficult, a small level of plasticizer may be tolerable without adversely affecting the heat resistance properties. For example, perhaps 0.5 phr to 5 phr of a fatty acid, polyethylene glycol, wax, bis-stearamide, mineral, or phthalate, may be used.

In another embodiment, an amine or pyridine compound is used, preferably in addition to a metal cation, to produce a reduced melt flow ionomer. Suitable examples include ethylamine, methylamine, diethylamine, tert-butylamine, dodecylamine, etc.

The addition of fillers, fibers, flakes is also believed to promote low flow. Particularly preferred additives of this nature include, but are not limited to, very-high-surface-area fillers that have an affinity for the acid groups in ionomer. In particular, fillers, fibers or flakes having cationic nature such that they may also contribute to the neutralization of the ionomer are suitable. Aluminum oxide comprising fillers are preferred. Also, silica, fumed silica, or precipitated silica, such as those sold under the tradename HISIL from PPG Industries, or carbon black. Nano-scale materials are also preferred and include, but are not limited to, nanotubes, nanoflakes, nanofillers, or nanoclays.

In another embodiment, a peroxide or other source of free radicals is added to the ionomer and is allowed to react (in an extruder or in an injection molding machine, just prior to the golf ball layer being molded). The peroxide is added at a relatively low activity level of about 0.01 to 5.00 phr, more preferably about 0.025 to 2.50 phr, and most preferably about 0.05 to 1.50 phr.

In another embodiment, a pre-molded layer of a golf ball comprising an ionomeric composition is treated with radiation (i.e., such as e-beam, gamma, X-ray, UV, etc.) to effect crosslinking and thus increase the heat resistance of the layer. Additionally, post-molding treatment, involving dipping or soaking the ionomer layer in a solution of a neutralizing or crosslinking agent, may be employed to reduce flow of the surface of the layer upon exposure to heating while adding the outer core layer. For example, exposing the molded layer to a peroxide solution followed by heating to crosslink the "skin" of the ionomer layer, or soaking the molded layer in a solution of aluminum acetylacetonate or aluminum isopropoxide to neutralize the "skin" of the ionomer layer, are suitable.

The low flow and/or improved heat resistance compositions herein may be used in any core and/or cover layer where a layer is molded over the low flow composition in a manner that would cause conventional materials to flow or flow-through that layer upon heating. For example the low flow composition may be used in a center, intermediate, or outer core layer, or in a cover layer of a multilayer golf ball, wherein the low flow composition is overmolded with a material that requires processing at such a temperature at or above the flow or melt temperature of the substrate layer.

A preferred embodiment includes the inner cover layers disclosed herein. Another preferred embodiment is a thermoplastic inner cover layer over which is molded a crosslinked diene rubber composition requiring a cure temperature well above the melting point of the thermoplastic inner cover layer material. Another preferred embodiment is an inner cover layer of a multilayer golf ball wherein the outer cover layer comprises a crosslinked diene rubber composition. An alternative embodiment is an inner cover layer of a multilayer golf ball where the outer cover layer comprises a thermoplastic polyurethane or polyurea that is processed at elevated temperatures. Typically such materials are either injection molded directly over the inner cover layer using a retractable pin molding process or by first injection molding half shells of the TPU followed by compression molding the half shells over the inner layer (which has previously been molded over the core). It is the latter process of compression molding a high melt temperature material (i.e., TPU) over the inner cover layer which is very difficult to perform without the inner cover "leaking" out at the equator. Any combination of neutralization and treatment or altering method disclosed herein may also be used.

In another embodiment a blend of ionomer and a higher temperature melting thermoplastic resin is employed. For example, a blend of ionomer with polyamide, polyester, polyethylene and PE containing low levels of (meth)acrylic acid, HYTREL etc., will increase the temperature resistance of the thermoplastic core layer. A preferred example is a blend of a zinc ionomer (copolymer or terpolymer type) with NYLON 11 or NYLON 12 (although NYLON 6 or NYLON 66 may also be used). Nylons with better moisture stability are preferred.

In another embodiment an organosilane is grafted onto the ionomer backbone using a catalyst via extrusion producing a still mainly thermoplastic material which is then injection or compression molded into an inner cover layer. The bulk of the crosslinking is achieved later by reacting this layer by exposing it to moisture where the water molecules diffuse into the cover and react with the organosilane side chains producing siloxane crosslinks which directly join together the ionomer chains creating a crosslinked network that is more resistant to heat and pressure Another embodiment is a blend of ionomer with a reactive polymer, such as an epoxy resin or an epoxy-group functional polymer, such as glycidyl (meth)acrylate polymers disclosed in U.S. Pat. No. 4,968,752 to DuPont-Mitsui or U.S. Pat. Nos. 5,155,157 and 5,091,478. Also suitable are epoxy-acid-tert amines as disclosed in U.S. Pat. No. 6,087,417. A FUSABOND-type polymer containing very high levels of maleic anhydride may also be suitable. Other examples include DuPont BEXLOY and REFLECTIONS polymers.

Other suitable thermoplastic compositions for use in the inner cover layers include, but are not limited to, the following polymers (including homopolymers, copolymers, and derivatives thereof) having good inherent thermal stability (e.g., they melt at a high enough temperature) and used at levels so as to not cause detrimental flow-through: (a) polyesters, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly (ethylene naphthenate), and those disclosed in U.S. Pat. Nos. 6,353,050, 6,274,298, and 6,001,930, the entire disclosures of which are hereby incorporated herein by reference, and blends of two or more thereof; (b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof; (c) polyurethanes, polyureas, polyurethane-polyurea hybrids, and blends of two or more thereof; (d) fluoropolymers, such as those disclosed in U.S. Pat. Nos. 5,691,066, 6,747,110 and 7,009,002, the entire disclosures of which are hereby incorporated herein by reference, and blends of two or more thereof; (e) polystyrenes, such as poly(styrene-co-maleic anhydride), acrylonitrile-butadiene-styrene, poly(styrene sulfonate), polyethylene styrene, and blends of two or more thereof; (f) polyvinyl chlorides and grafted polyvinyl chlorides, and blends of two or more thereof; (g) polycarbonates, blends of polycarbonate/acrylonitrile-butadiene-styrene, blends of polycarbonate/polyurethane, blends of polycarbonate/polyester, and blends of two or more thereof; (h) polyethers, such as polyarylene ethers, polyphenylene oxides, block copolymers of alkenyl aromatics with vinyl aromatics and polyamicesters, and blends of two or more thereof; (i) polyimides, polyetherketones, polyamideimides, and blends of two or more thereof; and (j) polycarbonate/polyester copolymers and blends.

Other suitable thermoplastic compositions for use in the inner cover layers include, but are not limited to, the following polymers (including homopolymers, copolymers, and derivatives thereof) treated by a radiation source (discussed above) and/or a peroxide (or other altering method described herein) so as to not cause detrimental flow-through: (a) non-ionomeric acid polymers, such as E/Y- and E/X/Y-type copolymers, wherein E is an olefin (e.g., ethylene), Y is a carboxylic acid such as acrylic, methacrylic, crotonic, maleic, fumaric, or itaconic acid, and X is a softening comonomer such as vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons; and blends of two or more thereof; (b) metallocene-catalyzed polymers, such as those disclosed in U.S. Pat. Nos. 6,274,669, 5,919, 862, 5,981,654, and 5,703,166, the entire disclosures of which are hereby incorporated herein by reference, and blends of two or more thereof; (c) polypropylenes and polyethylenes, particularly grafted polypropylene and grafted polyethylenes that are modified with a functional group, such as maleic anhydride of sulfonate, and blends of two or more thereof; (d) polyvinyl acetates, preferably having less than about 9% of vinyl acetate by weight, and blends of two or more thereof; and (e) polyvinyl alcohols, and blends of two or more thereof.

Ionomeric compositions suitable for forming the inner cover layer comprise one or more acid polymers, each of which is partially- or highly-neutralized (up to 100% and without the use of fatty acid/salts), and optionally additives, fillers, and/or melt flow modifiers. Suitable acid polymers are salts of homopolymers and copolymers of α,β-ethylenically unsaturated mono- or di-carboxylic acids, and combinations thereof, optionally including a softening monomer, and preferably having an acid content (prior to neutralization) of from 1 wt % to 30 wt %, more preferably from 5 wt % to 20 wt %. The acid polymer is preferably neutralized to 70 wt % or higher, including up to 100 wt %, with a suitable cation source, such as metal cations and salts thereof, organic amine compounds, ammonium, and combinations thereof. Preferred cation sources are metal cations and salts thereof, wherein the metal is preferably lithium, sodium, potassium, magnesium, calcium, barium, lead, tin, zinc, aluminum, manganese, nickel, chromium, copper, or a combination thereof.

Suitable additives and fillers include, for example, blowing and foaming agents, optical brighteners, coloring agents, fluorescent agents, whitening agents, UV absorbers, light stabilizers, defoaming agents, processing aids, mica, talc, nanofillers, antioxidants, stabilizers, softening agents, fragrance components, plasticizers, impact modifiers, acid copolymer wax, surfactants; inorganic fillers, such as zinc oxide, titanium dioxide, tin oxide, calcium oxide, magnesium oxide, barium sulfate, zinc sulfate, calcium carbonate, zinc carbonate, barium carbonate, mica, talc, clay, silica, lead silicate, and the like; high specific gravity metal powder fillers, such as tungsten powder, molybdenum powder, and the like; regrind, i.e., cover material that is ground and recycled; and nano-fillers.

In a particular embodiment, the inner cover layer is formed from a blend of two or more ionomers. In a particular aspect of this embodiment, the intermediate core layer is formed from a 50/50 wt % blend of two different highly-neutralized ethylene/methacrylic acid copolymers.

In another particular embodiment, the inner cover layer is formed from a blend of one or more ionomers and a maleic anhydride-grafted non-ionomeric polymer. In a particular aspect of this embodiment, the non-ionomeric polymer is a metallocene-catalyzed polymer. In another particular aspect of this embodiment, the inner cover layer is formed from a blend of a highly-neutralized ethylene/methacrylic acid copolymer and a maleic anhydride-grafted metallocene-catalyzed polyethylene.

In yet another particular embodiment, the inner cover layer is formed from a composition selected from the group consisting of highly-neutralized ionomers optionally blended with a maleic anhydride-grafted non-ionomeric polymer; polyester elastomers; polyamide elastomers; and combinations of two or more thereof.

The thermoplastic inner cover layer is optionally treated or admixed with a thermoset diene composition to reduce or prevent flow upon overmolding. Optional treatments may also include the addition of peroxide to the material prior to molding, or a post-molding treatment with, for example, a crosslinking solution, electron beam, gamma radiation, isocyanate or amine solution treatment, or the like. Such treatments may prevent the inner cover layer from melting and flowing or "leaking" out at the mold equator, as the thermoset outer cover layer is molded thereon at a temperature necessary to crosslink the outer core layer, which is typically from 280° F. (138° C.) to 360° F. (182° C.) for a period of about 5 to 30 minutes.

The following examples are representative of the novel inner cover layer compositions of the invention and are non-limiting in scope of what materials are suitable. Table I below presents 14 compositions, the first 10 being representative of the invention and the final 4 being controls.

TABLE I

| | Base polymer | Ratio | Cross-linking Reagent | Cross-linking Reagent Added* | Final Neutral'zn Achieved (Mole %) | Final Ionomer Type | e-beam dose (Mrad) |
|---|---|---|---|---|---|---|---|
| | | | Low-flow | | | | |
| Ex 1 | SURLYN ® 9120[a] | 100 | NaOH | ~41 | 77 | Na/Zn | — |
| Ex 2 | SURLYN ® 9120 | 100 | NaOH | ~51 | 87 | Na/Zn | — |
| Ex 3 | PRIMACOR ® 5986[b] | 100 | Li(OH)•$H_2$0 | 90 | 86 | Li | — |
| Ex 4 | PRIMACOR ® 5986 | 100 | Li(OH)•$H_2$0 | 98 | 95 | Li | — |
| Ex 5 | PRIMACOR ® 5986 | 100 | Li(OH)•$H_2$0 | 105 | 100 | Li | — |
| Ex 6 | NUCREL ® 2906[c] | 100 | Zn diacetate•2$H_2$0 | 110 | ~100 | Zn | — |
| | | | Treated | | | | |
| Ex 7 | SURLYN ® 8140[d]/ SURLYN ® 9120 | 50/50 | — | 0 | 37 | Na/Zn | 10 |
| Ex 8 | SURLYN ® 8140/ SURLYN ® 9120 | 50/50 | — | 0 | 37 | Na/Zn | 20 |
| Ex 9 | SURLYN ® 8140/ SURLYN ® 9120 | 50/50 | — | 0 | 37 | Na/Zn | 30 |
| Ex 10 | SURLYN ® 9120 | 100 | PERKADOX ® BC | 0 | 36 | Zn | — |

TABLE I-continued

| | Base polymer | Ratio | Cross-linking Reagent | Cross-linking Reagent Added* | Final Neutral'zn Achieved (Mole %) | Final Ionomer Type | e-beam dose (Mrad) |
|---|---|---|---|---|---|---|---|
| | | | Comparative | | | | |
| CE1 | SURLYN ® 9120 | 100 | NaOH | ~23 | 59 | Na/Zn | — |
| CE2 | SURLYN ® 8140/ SURLYN ® 9120 | 50/50 | — | 0 | 37 | Na/Zn | — |
| CE3 | SURLYN ® 8940[e]/ SURLYN ® 9910[f] | 75/25 | — | 0 | 38 | Na/Zn | — |
| CE4 | HPF 2000[g] | 100 | — | 0 | ~100 | Mg | — |

*to achieve additional mole % neutralization as indicated
[a]partially Zn-neutralized, 19 wt. % methacrylic acid-ethylene copolymeric ionomer from DuPont
[b]unneutralized, 20.5 wt % acrylic acid-ethylene copolymer from Dow
[c]unneutralized, 19 wt % methacrylic acid-ethylene copolymer from DuPont
[d]partially Na-neutralized, 19 wt % methacrylic acid-ethylene copolymeric ionomer from DuPont
[e]partially Na-neutralized, 15 wt % methacrylic acid-ethylene copolymeric ionomer from DuPont
[f]partially Zn-neutralized, 15 wt % methacrylic acid-ethylene copolymeric ionomer from DuPont
[g]fully Mg-neutralized, ~40% fatty acid salt modified, acrylic acid-ethylene-n-butyl acrylate terpolymeric ionomer available from DuPont
[h]dicumyl peroxide available from Akzo Nobel Examples 1-6 and CE1 were made by combining the base polymer and the cross-linking reagent in a twin-screw extruder at appropriate zone temperatures, screw speed, and feed rates to achieve the final mole % neutralization indicated in TABLE I. It is well known that cross-linking reagents can be added to the extruder directly as a powder, as a caustic aqueous solution, or as a masterbatch on a suitable carrier polymer. Examples 7-9 were made by injection molding a dry-blend of SURLYN 8140 and 9120 around a core, and then radiation treating as indicated. The melt flow index was then measured by removing and grinding the layer. Example 10 was made by compounding 0.5 phr of Perkadox BC into SURLYN 9120 and curing for 15 min at 350° F. prior to measuring melt flow. Comparative examples 2-3 were prepared by melt blending.

TABLE II

| | Melt Flow Condition - Temp (° C.)/Mass (kg) | | | | |
|---|---|---|---|---|---|
| | 190/2.16 (g/10 min) | 230/2.16 (g/10 min) | 265/5 (g/10 min) | 280/10 (g/10 min) | Pass/Fail |
| | | | Low-flow | | |
| Ex 1 | L | 0.70 | 8.00 | 33.4 | Pass |
| Ex 2 | L | 0.34 | 3.76 | 19.5 | Pass |
| Ex 3 | L | 0.46 | 9.7 | 44 | Pass |
| Ex 4 | L | L | 2.9 | 18.0 | Pass |
| Ex 5 | L | L | 0.90 | 5.49 | Pass |
| Ex 6 | L | 0.39 | 3.83 | 14.35 | Pass |
| | | | Treated | | |
| Ex 7 | L | L | 0.37 | 5.82 | Pass |
| Ex 8 | L | L | L | 0.12 | Pass |
| Ex 9 | L | L | L | L | Pass |
| Ex 10 | L | 0.13 | 3.86 | 18.4 | Pass |
| | | | Comparative | | |
| CE1 | 0.25 | 1.64 | 18.16 | ~79 | Fail |
| CE2 | 2.41 | 14.34 | ~86 | x | Fail |
| CE3 | 2.14 | 9.38 | ~77 | x | Fail |
| CE4 | 1.28 | 11.17 | ~61 | x | Fail |

x = unmeasurable (flow was too high to make a meaningful measurement)
L = low flow (flow was so low that no measureable material was extruded)

The melt flow rate characterizes the resistance to flow of a molten plastic material and was determined in accordance with ASTM Standard D1238-04C using a Tinius-Olsen Extrusion Plastometer. The quantity of melt flow is measured by placing the sample in a heated barrel where it is held for a certain time then forced through a die using a weighted piston. The ASTM standard specifies the barrel and die dimensions and suggests a number of temperature and weight conditions typically chosen to give results between 0.15 and 50 g/10 min. Melt flow results are reported as grams of material extruded over a 10-minute time interval at a specified temperature and load.

TABLE II contains melt flow data for each of the examples and comparative examples, as well pass/fail data indicating whether a rubber outer cover layer could be compression molded over a layer of each material in TABLE I without that layer leaking out into the rubber outer cover layer. Most of the melt flow temperature and mass conditions in TABLE II can be found in the ASTM method that was used to generate the data in the table. The 190° C./2.16 kg condition is an industry standard used to report the melt flow of ionomers. Conventional thought was that an ionomer with a melt flow index, under these conditions, of less than about 0.5 would be unmoldable (not melt processible) for golf ball applications. The ASTM method suggests that if a melt flow value below about 0.15 g/10 minutes is obtained, that a higher temperature and/or mass should be used and suggests alternative combinations. TABLE II shows a progression of increasing temperature/mass combinations to better characterize the flow properties of each material. Generally, materials should be compared to each other under identical melt flow conditions. In some cases, however, information can be obtained by comparing melt flow values under different conditions. For example, a material that has a melt flow of 3 g/10 minutes at 280° C./10 kg flows less than a material that has the same melt flow at 190° C./2.16 kg. The melt flow conditions that we selected were also useful in determining injection molding conditions for each material and as a predictor of overmolding success or failure—CE1-4 all have substantially-higher melt flow values at a given condition relative to the inventive examples and are, therefore, insufficient for the inventive cover layers. The absolute value of the melt flow at each condition can be used to predict the suitability of a candidate material for golf ball constructions described herein.

Suitable compositions for forming the outer cover layer include the rubber compositions disclosed above for forming the center layer(s). The outer cover layer composition may be the same or a different rubber composition than the composition(s) used to form the center layer(s).

The outer cover layer may further comprise from 1 to 100 phr of a stiffening agent. Suitable stiffening agents include, but are not limited to, ionomers, acid copolymers and terpolymers, polyamides, and polyesters. A transpolyisoprene (e.g., TP-301 transpolyisoprene from Kuraray) or transbutadiene rubber may also be added to increase stiffness to a cover layer and/or improve cold-forming properties, which may improve processability by making it easier to mold inner cover layer half-shells during the golf ball manufacturing process. When included in a cover layer composition, the stiffening agent is preferably present in an amount of from 5 to 10 pph.

In one embodiment, the specific gravity of one or more of the cover layers is increased. Suitable fillers for increasing specific gravity include, but are not limited to, metal and metal alloy powders, including, but not limited to, bismuth powder, boron powder, brass powder, bronze powder, cobalt powder, copper powder, nickel-chromium iron metal powder, iron metal powder, molybdenum powder, nickel powder, stainless steel powder, titanium metal powder zirconium oxide powder, tungsten metal powder, beryllium metal powder, zinc metal powder, and tin metal powder; metal flakes, including, but not limited to, aluminum flakes; metal oxides, including, but not limited to, zinc oxide, iron oxide, aluminum oxide, titanium dioxide, magnesium oxide, zirconium oxide, and tungsten trioxide; metal stearates; particulate carbonaceous materials including, but not limited to, graphite and carbon black; and nanoparticulates and hybrid organic/inorganic materials. Particularly suitable density-increasing fillers include, but are not limited to, tungsten, tungsten oxide, tungsten metal powder, zinc oxide, barium sulfate, and titanium dioxide.

In another embodiment, the specific gravity of one or more of the cover layers is reduced. The specific gravity of a layer can be reduced by incorporating cellular resins, low specific gravity fillers, fibers, flakes, or spheres, or hollow microspheres or balloons, such as glass bubbles or ceramic zeospheres, in the polymeric matrix. The specific gravity of a layer can also be reduced by foaming. Typical physical foaming/blowing agents include volatile liquids such as freons, other halogenated hydrocarbons, water, aliphatic hydrocarbons, gases, and solid blowing agents, i.e., compounds that liberate gas as a result of desorption of gas. Typical chemical foaming/blowing agents include inorganic agents, such as ammonium carbonate and carbonates of alkali metals, and organic agents, such as azo and diazo compounds. Suitable azo compounds include, but are not limited to, 2,2'-azobis(2-cyanobutane), 2,2'-azobis(methylbutyronitrile), azodicarbonamide, p,p'-oxybis(benzene sulfonyl hydrazide), p-toluene sulfonyl semicarbazide, and p-toluene sulfonyl hydrazide. Blowing agents also include CELOGEN foaming/blowing agents from Lion Copolymer; OPEX foaming/blowing agents from Chemtura Corporation; nitroso compounds, sulfonylhydrazides, azides of organic acids and their analogs, triazines, triazole and tetrazole derivatives, sulfonyl semicarbazides, urea derivatives, guanidine derivatives, and esters such as alkoxyboroxines. Blowing agents also include agents that liberate gasses as a result of chemical interaction between components, such as mixtures of acids and metals, mixtures of organic acids and inorganic carbonates, mixture of nitrites and ammonium salts, and the hydrolytic decomposition of urea. Suitable foaming/blowing agents also include expandable microspheres, such as EXPANCEL microspheres from Akzo Nobel.

The specific gravity of each of the cover layers is from 0.50 g/cm$^3$ to 5.00 g/cm$^3$. Cover layers having an increased specific gravity preferably have a specific gravity of 0.95 g/cm$^3$ or greater, or 1.00 g/cm$^3$ or greater, or 1.05 g/cm$^3$ or greater, or 1.10 g/cm$^3$ or greater, or 1.20 g/cm$^3$ or greater, or 1.30 g/cm$^3$ or greater, or 1.40 g/cm$^3$ or greater. Cover layers having a reduced specific gravity preferably have a specific gravity of 1.05 g/cm$^3$ or less, or 0.95 g/cm$^3$ or less, or 0.90 g/cm$^3$ or less, or 0.85 g/cm$^3$ or less. In a particular embodiment, the specific gravity of inner cover is 0.95 g/cm$^3$ or greater, or greater than 1.05 g/cm$^3$, or 1.15 g/cm$^3$ or greater; and the specific gravity of the outer cover layer is 1.30 g/cc or less, or 1.20 g/cm$^3$ or less, or from 0.90 g/cm$^3$ to 1.20 g/cm$^3$. In a particular aspect of this embodiment, the specific gravity of the outer cover layer is less than the specific gravity of the intermediate layer. In another particular aspect of this embodiment, the inner core is formed from a composition wherein the specific gravity has been decreased; and the outer core layer is formed from a composition wherein the specific gravity has been increased, preferably with tungsten filler. The weight distribution of core and cover layers disclosed herein can be varied to achieve certain desired parameters, such as spin rate, compression, and initial velocity.

The core preferably has an overall diameter of 1.25 inches or greater, or 1.35 inches or greater, or 1.390 inches or greater, or 1.45 inches or greater, or an overall diameter within a range having a lower limit of 0.25 or 0.50 or 0.75 or 1.00 or 1.25 or 1.35 or 1.39 or 1.40 or 1.44 inches and an upper limit of 1.46 or 1.49 or 1.50 or 1.55 or 1.58 or 1.60 inches.

The core has a center hardness within a range having a lower limit of 20 or 25 or 30 or 35 or 40 or 45 or 50 or 55 Shore C and an upper limit of 60 or 65 or 70 or 75 or 90 Shore C. The core has an outer surface hardness within a range having a lower limit of 20 or 50 or 70 or 75 Shore C and an upper limit of 75 or 80 or 85 or 90 or 95 Shore C.

The core has a negative hardness gradient, a zero hardness gradient, or a positive hardness gradient of up to 45 Shore C. Preferably, the center has a positive hardness gradient wherein the difference between the center hardness and the surface hardness of the center is from 10 to 45 Shore C.

The core has an overall compression of 90 or less, or 80 or less, or 70 or less, or 60 or less, or 50 or less, or 40 or less, or 20 or less, or a compression within a range having a lower limit of 10 or 20 or 30 or 35 or 40 and an upper limit of 50 or 60 or 70 or 80 or 90.

One or more optional outer core layers are formed from thermoset or thermoplastic compositions and have a thickness within a range having a lower limit of 0.005 or 0.01 or 0.02 or 0.04 inches and an upper limit of 0.05 or 0.10 or 0.20 or 0.30 or 0.40 inches In one embodiment, the outer core layer has a surface hardness of 45 Shore C or greater, or 70 Shore C or greater, or 75 Shore C or greater, or 80 Shore C or greater, or a surface hardness within a range having a lower limit of 45 or 70 or 80 Shore C and an upper limit of 90 or 95 Shore C. In a particular aspect of this embodiment, the surface hardness of the outer core layer is greater than the surface hardness of the center. In another particular aspect of this embodiment, the surface hardness of the outer core layer is less than the surface hardness of the center. In another embodiment, the outer core layer has a surface hardness within a range having a lower limit of 50 or 60 or 65 Shore C and an upper limit of 70 or 75 or 80 Shore C. In a particular aspect of this embodiment, the surface hardness of the outer core layer is less than the surface hardness of the center.

In another embodiment, the outer core layer has a surface hardness of 20 Shore C or greater, or 30 Shore C or greater, or 35 Shore C or greater, or 40 Shore C or greater, or a surface hardness within a range having a lower limit of 20 or 30 or 35 or 40 or 50 Shore C and an upper limit of 60 or 70 or 80 Shore C. In a particular aspect of this embodiment, the outer core layer is formed from a rubber composition selected from those disclosed in U.S. Patent Application Publication Nos. 2009/0011857 and 2009/0011862, the entire disclosures of which are hereby incorporated herein by reference.

Golf ball cores of the present invention typically have a coefficient of restitution ("COR") at 125 ft/s of at least 0.750, or at least 0.775 or at least 0.780, or at least 0.782, or at least 0.785, or at least 0.787, or at least 0.790, or at least 0.795, or at least 0.798, or at least 0.800.

Suitable outer cover materials include, but are not limited to, ionomer resins and blends thereof (e.g., SURLYN ionomer resins and DuPont HPF 1000 and HPF 2000; IOTEK ionomers from ExxonMobil; AMPLIFY IO ionomers of ethylene acrylic acid copolymers from Dow; and CLARIX ionomer resins from Schulman); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, PEBAX thermoplastic polyether block amides from Arkema, Inc.; crosslinked transpolyisoprene and blends thereof; polyester-based thermoplastic elastomers, such as HYTREL from DuPont; polyurethane-based thermoplastic elastomers, such as ELASTOLLAN from BASF; synthetic or natural vulcanized rubber; and combinations thereof. In a particular embodiment, the cover is a single layer formed from a composition selected from the group consisting of ionomers, polyester elastomers, polyamide elastomers, and combinations of two or more thereof.

Compositions comprising an ionomer or a blend of two or more ionomers are particularly suitable cover materials. Preferred ionomeric outer cover compositions include: (a) a composition comprising a "high acid ionomer" (i.e., having an acid content of greater than 16 wt %), such as SURLYN 8150; (b) a composition comprising a high acid ionomer and a maleic anhydride-grafted non-ionomeric polymer (e.g., FUSABOND functionalized polymers). A particularly preferred blend of high acid ionomer and maleic anhydride-grafted polymer is a 84 wt %/16 wt % blend of SURLYN 8150 and FUSABOND; c) a composition comprising a 50/45/5 blend of SURLYN 8940/SURLYN 9650/NUCREL 960, preferably having a material hardness of from 80 to 85 Shore C; (d) a composition comprising a 50/25/25 blend of SURLYN® 8940/SURLYN 9650/SURLYN 9910, preferably having a material hardness of about 90 Shore C; (e) a composition comprising a 50/50 blend of SURLYN 8940/SURLYN 9650, preferably having a material hardness of about 86 Shore C; (f) a composition comprising a blend of SURLYN 7940/SURLYN 8940, optionally including a melt flow modifier; (g) a composition comprising a blend of a first high acid ionomer and a second high acid ionomer, wherein the first high acid ionomer is neutralized with a different cation than the second high acid ionomer (e.g., 50/50 blend of SURLYN 8150 and SURLYN 9150), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % SURLYN 8140, 40-50 wt % SURLYN 9120, and 0-10 wt % SURLYN 6320).

Ionomeric outer cover compositions can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, thermoplastic polyether block amides (e.g., PEBAX block copolymers from Arkema, Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, plyethylene-(meth)acrylic acid, functionalized polymers with maleic anhydride grafting, FUSABOND functionalized polymers from DuPont, functionalized polymers with epoxidation, elastomers (e.g., ethylene propylene diene monomer rubber, metallocene-catalyzed polyolefin) and ground powders of thermoset elastomers.

Ionomer golf ball outer cover compositions may include a flow modifier, such as, but not limited to, NUCREL acid copolymer resins, and particularly NUCREL 960, from DuPont.

Polyurethanes, polyureas, and blends and hybrids of polyurethane/polyurea are also particularly suitable for forming cover layers. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

While the inventive golf ball may be formed from a variety of differing cover materials, preferred outer cover layer materials include, but are not limited to, (1) polyurethanes, such as those prepared from polyols or polyamines and diisocyanates or polyisocyanates and/or their prepolymers, and those disclosed in U.S. Pat. Nos. 5,334,673 and 6,506,851; (2) polyureas, such as those disclosed in U.S. Pat. Nos. 5,484,870 and 6,835,794; (3) polyurethane-urea hybrids, blends or copolymers comprising urethane or urea segments; and (4) other suitable polyurethane compositions comprising a reaction product of at least one polyisocyanate and at least one curing agent are disclosed in U.S. Pat. Nos. 7,105,610 and 7,491,787, all of which are incorporated herein by reference.

Suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. Suitable polyurethanes are described in U.S. Pat. No. 7,331,878, which is incorporated by reference in its entirety.

Exemplary polyisocyanates suitable for use in the outer cover layers of the invention include, but are not limited to, 4,4'-diphenylmethane diisocyanate ("MDI"); polymeric MDI; carbodiimide-modified liquid MDI; 4,4'-dicyclohexylmethane diisocyanate; p-phenylene diisocyanate ("PPDI"); m-phenylene diisocyanate; toluene diisocyanate ("TDI"); 3,3'-dimethyl-4,4'-biphenylene diisocyanate; isophoronediisocyanate; 1,6-hexamethylene diisocyanate ("HDI"); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., diisocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer isocyanate groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 8.0% NCO, more preferably no greater than about 7.8%, and most preferably no greater than about 7.5% NCO with a level of NCO of about 7.2 or 7.0, or 6.5% NCO commonly used.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE 300, from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight PTMEG; 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy]ethoxy} benzene; 1,4-butanediol; 1,5-pentanediol; 1,6-hexanediol; resorcinol-di-(.beta.-hydroxyethyl)ether; hydroquinone-di-(.beta.-hydroxyethyl) ether; and mixtures thereof. Preferred hydroxy-terminated curatives include 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy]ethoxy} benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes are used to form one or more of the cover layers, preferably the outer cover layer, and may be selected from among both castable thermoset and thermoplastic polyurethanes.

In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. A catalyst may be employed to promote the reaction between the curing agent and the isocyanate and polyol, or the curing agent and the prepolymer.

Saturated diisocyanates which can be used include, without limitation, ethylene diisocyanate; propylene-1,2-diisocyanate; tetramethylene-1,4-diisocyanate; 1,6-hexamethylene-diisocyanate; 2,2,4-trimethylhexamethylene diisocyanate; 2,4,4-trimethylhexamethylene diisocyanate; dodecane-1,12-diisocyanate; dicyclohexylmethane diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; isophorone diisocyanate; methyl cyclohexylene diisocyanate; triisocyanate of HDI; triisocyanate of 2,2,4-trimethyl-1,6-hexane diisocyanate. The most preferred saturated diisocyanates are 4,4'-dicyclohexylmethane diisocyanate and isophorone diisocyanate.

Saturated polyols are appropriate for use in this invention and include, without limitation, polyether polyols such as PTMEG and poly(oxypropylene) glycol. Suitable saturated polyester polyols include polyethylene adipate glycol, polyethylene propylene adipate glycol, polybutylene adipate glycol, polycarbonate polyol and ethylene oxide-capped polyoxypropylene diols. Saturated polycaprolactone polyols which are useful in the invention include diethylene glycol-initiated polycaprolactone, 1,4-butanediol-initiated polycaprolactone, 1,6-hexanediol-initiated polycaprolactone; trimethylol propane-initiated polycaprolactone, neopentyl glycol initiated polycaprolactone, and PTMEG-initiated polycaprolactone. The most preferred saturated polyols are PTMEG and PTMEG-initiated polycaprolactone.

Suitable saturated curatives include 1,4-butanediol, ethylene glycol, diethylene glycol, PTMEG, propylene glycol; trimethanolpropane; tetra-(2-hydroxypropyl)-ethylenediamine; isomers and mixtures of isomers of cyclohexyldimethylol, isomers and mixtures of isomers of cyclohexane bis(methylamine); triisopropanolamine; ethylene diamine; diethylene triamine; triethylene tetramine; tetraethylene pentamine; 4,4'-dicyclohexylmethane diamine; 2,2,4-trimethyl-1,6-hexanediamine; 2,4,4-trimethyl-1,6-hexanediamine; diethyleneglycol di-(aminopropyl)ether; 4,4'-bis-(sec-butylamino)-dicyclohexylmethane; 1,2-bis-(sec-butylamino)cyclohexane; 1,4-bis-(sec-butylamino) cyclohexane; isophorone diamine; hexamethylene diamine; propylene diamine; 1-methyl-2,4-cyclohexyl diamine; 1-methyl-2,6-cyclohexyl diamine; 1,3-diaminopropane; dimethylamino propylamine; diethylamino propylamine; imido-bis-propylamine; isomers and mixtures of isomers of diaminocyclohexane; monoethanolamine; diethanolamine; triethanolamine; monoisopropanolamine; and diisopropanolamine. The most preferred saturated curatives are 1,4-butanediol, 1,4-cyclohexyldimethylol and 4,4'-bis-(sec-butylamino)-dicyclohexylmethane.

Alternatively, other suitable polymers include partially- or fully-neutralized ionomer, metallocene, or other single-site catalyzed polymer, polyester, polyamide, non-ionomeric thermoplastic elastomer, copolyether-esters, copolyether-amides, polycarbonate, polybutadiene, polyisoprene, polystryrene block copolymers (such as styrene-butadiene-styrene), styrene-ethylene-propylene-styrene, styrene-ethylene-butylene-styrene, and the like, and blends thereof. Thermosetting polyurethanes or polyureas are suitable for outer cover layers.

Additionally, polyurethane can be replaced with or blended with a polyurea material. Polyureas are distinctly different from polyurethane compositions, but also result in desirable aerodynamic and aesthetic characteristics when used in golf ball components. The polyurea-based compositions are preferably saturated in nature.

Without being bound to any particular theory, it is now believed that substitution of the long chain polyol segment in the polyurethane prepolymer with a long chain polyamine oligomer soft segment to form a polyurea prepolymer, improves shear, cut, and resiliency, as well as adhesion to other components. Thus, the polyurea compositions of this invention may be formed from the reaction product of an isocyanate and polyamine prepolymer crosslinked with a curing agent. For example, polyurea-based compositions of the invention may be prepared from at least one isocyanate, at least one polyether amine, and at least one diol curing agent or at least one diamine curing agent.

Any polyamine available to one of ordinary skill in the art is suitable for use in the polyurea prepolymer. Polyether amines are particularly suitable for use in the prepolymer. As used herein, "polyether amines" refer to at least polyoxyalkyleneamines containing primary amino groups attached to the terminus of a polyether backbone. Due to the rapid reaction of isocyanate and amine, and the insolubility of many urea products, however, the selection of diamines and polyether amines is limited to those allowing the successful formation of the polyurea prepolymers. In one embodiment, the polyether backbone is based on tetramethylene, propylene, ethylene, trimethylolpropane, glycerin, and mixtures thereof.

Suitable polyether amines include, but are not limited to, methyldiethanolamine; polyoxyalkylenediamines such as, polytetramethylene ether diamines, polyoxypropylenetriamine, and polyoxypropylene diamines; poly(ethylene oxide capped oxypropylene) ether diamines; propylene oxide-based triamines; triethyleneglycoldiamines; trimethylolpropane-based triamines; glycerin-based triamines; and mixtures thereof. In one embodiment, the polyether amine used to form the prepolymer is JEFFAMINE D2000 from Huntsman Chemical Co. of Austin, Tex.

The molecular weight of the polyether amine for use in the polyurea prepolymer may range from about 100 to about 5000. In one embodiment, the polyether amine molecular weight is about 200 or greater, preferably about 230 or greater. In another embodiment, the molecular weight of the polyether amine is about 4000 or less. In yet another embodiment, the molecular weight of the polyether amine is about 600 or greater. In still another embodiment, the molecular weight of the polyether amine is about 3000 or less. In yet another embodiment, the molecular weight of the polyether amine is between about 1000 and about 3000, more preferably is between about 1500 to about 2500, and most preferably from 2000 to 2500. Because lower molecular weight polyether amines may be prone to forming solid polyureas, a higher molecular weight oligomer, such as JEFFAMINE D2000, is preferred.

Other suitable castable polyurea compositions for use in the golf balls of the present invention include those formed from the reaction product of a prepolymer formed from an isocyanate and an amine-terminated PTMEG and an amine-terminated curing agent, and those formed from the reaction product of a polyurea prepolymer cured with an amine-terminated PTMEG. In either scenario, the amine-terminated PTMEG is terminated with secondary amines. In addition, the amine-terminated PTMEG may be a copolymer with polypropylene glycol, wherein the PTMEG is end-capped with one or more propylene glycol units to form the copolymer.

Another suitable composition includes a prepolymer including the reaction product of an isocyanate-containing component and an amine-terminated component, wherein the amine-terminated component includes a copolymer of PTMEG and polypropylene glycol including at least one terminal amino group; and an amine-terminated curing agent. In this aspect of the invention the prepolymer may include about 4% to about 9% NCO groups by weight of the prepolymer.

In one embodiment, the at least one terminal amino group includes secondary amines. In another embodiment, the at least one terminal amino group includes a terminal secondary amino group at both ends of the copolymer. In yet another embodiment, the amine-terminated curing agent includes a secondary diamine.

The polyureas of the present invention also include a polyurea composition formed from a prepolymer formed from the reaction product of an isocyanate-containing compound and an isocyanate-reactive compound, wherein the isocyanate-reactive compound includes PTMEG homopolymer having a molecular weight of about 1800 to 2200 and terminal secondary amino groups; and an amine-terminated curing agent. In this aspect of the invention, the prepolymer may include about 6% to about 8% NCO groups by weight of the prepolymer. In addition, the PTMEG homopolymer may have a molecular weight of about 1900 to about 2100. In one embodiment, the amine-terminated curing agent includes a secondary diamine.

In one embodiment, the polyalkylene glycol includes polypropylene glycol, polyethylene glycol, and copolymers or mixtures thereof. In another embodiment, the amino groups include secondary amino groups. The amine-terminated curing agent may include an amine-terminated PTMEG. In one embodiment, the amine-terminated PTMEG includes at least one terminal secondary amino group.

Conventional aromatic polyurethane/urethane elastomers and polyurethane/urea elastomers are generally prepared by curing a prepolymer of diisocyanate and long chain polyol with at least one diol curing agent or at least one diamine curing agent, respectively. In contrast, the use of a long chain amine-terminated compound to form a polyurea prepolymer has been shown to improve shear, cut, and resiliency, as well as adhesion to other components.

The use of an amine-terminated PTMEG and/or an amine-terminated copolymer of PTMEG and polypropylene glycol ("PPG") in the prepolymer or as a curing agent provide enhanced shear, cut, and resiliency as compared to conventional polyurea elastomers. For example, the compositions of the invention have improved durability and performance characteristics over that of a polyurea composition formed with amine-terminated PPG.

The polyurea-based compositions of this invention may be formed in several ways: a) from a prepolymer that is the reaction product of an isocyanate-containing component and amine-terminated PTMEG chain extended with a curing agent; b) from a prepolymer that is the reaction product of an isocyanate-containing component and an amine-terminated copolymer of PTMEG and PPG chain extended with a curing agent; c) from a prepolymer that is the reaction product of a polyurea-based prepolymer chain extended with an amine-terminated PTMEG; and d) from a prepolymer that is the reaction product of a polyurea-based prepolymer chain extended with an amine-terminated copolymer of PTMEG and PPG.

For example, the compositions of the invention may be prepared from at least one isocyanate-containing component, at least one amine-terminated copolymer of PTMEG and PPG, preferably a secondary diamine, and at least one amine-terminated curing agent, preferably a secondary aliphatic diamine or primary aromatic diamine curing agent. The presence of PTMEG in the backbone provides better shear resistance as compared to a backbone including only PPG. Commercially-available amine-terminated PTMEG and/or copolymer of PTMEG and PPG include those sold by Huntsman Chemical under the tradenames XTJ-559, XTG-604, XTG-605, and XTG-653.

As briefly discussed above, some amines may be unsuitable for reaction with the isocyanate because of the rapid reaction between the two components. In particular, shorter chain amines are fast reacting. In one embodiment, however, a hindered secondary diamine may be suitable for use in the prepolymer. It is believed that an amine with a high level of stearic hindrance, e.g., a tertiary butyl group on the nitrogen atom, has a slower reaction rate than an amine with no hindrance or a low level of hindrance. For example, 4,4'-bis-(sec-butylamino)-dicyclohexylmethane (CLEARLINK 1000) may be suitable for use in combination with an isocyanate to form the polyurea prepolymer.

Any isocyanate available to one of ordinary skill in the art is suitable for use in the polyurea prepolymer. Isocyanates for use with the present invention include aliphatic, cycloaliphatic, araliphatic, aromatic, any derivatives thereof, and combinations of these compounds having two or more isocyanate groups per molecule. The isocyanates may be organic polyisocyanate-terminated prepolymers. The isocyanate-containing reactable component may also include any isocyanate-functional monomer, dimer, trimer, or multimeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic, aromatic, or linear or branched hydrocarbon moiety containing from about 1 to about 20 carbon atoms. The diisocyanate may also contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof. Copolymeric isocyanates, such as Bayer DESMODUR HL, which is a copolymer of TDI and HDI, are preferred.

Examples of diisocyanates that can be used with the present invention include, but are not limited to, substituted and isomeric mixtures including 2,2'-, 2,4'-, and 4,4'-diphenylmethane diisocyanate; 3,3'-dimethyl-4,4'-biphenylene diisocyanate; toluene diisocyanate; polymeric MDI; carbodiimide-modified liquid 4,4'-diphenylmethane diisocyanate; p-phenylene diisocyanate; m-phenylene diisocyanate; triphenyl methane-4,4'- and triphenyl methane-4,4'-triisocyanate; naphthylene-1,5-diisocyanate; 2,4'-, 4,4'-, and 2,2-biphenyl diisocyanate; polyphenyl polymethylene polyisocyanate; mixtures of MDI and PMDI; mixtures of PMDI and TDI; ethylene diisocyanate; propylene-1,2-diisocyanate; tetramethylene-1,2-diisocyanate; tetramethylene-1,3-diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4' dicyclohexylmethane diisocyanate; 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; m-tetramethylxylene diisocyanate; p-tetramethylxylene diisocyanate; trimerized isocyanurate of any polyisocyanate, such as isocyanurate of toluene diisocyanate; trimer of diphenylmethane diisocyanate; trimer of tetramethylxylene diisocyanate; isocyanurate of hexamethylene diisocyanate; isocyanurate of isophorone diisocyanate; and mixtures thereof; dimerized uredione of any polyisocyanate, such as uretdione of toluene diisocyanate; uretdione of hexamethylene diisocyanate; and mixtures thereof; modified polyisocyanate derived from the above isocyanates and polyisocyanates; and mixtures thereof.

Examples of saturated diisocyanates that can be used with the present invention include, but are not limited to, ethylene diisocyanate; propylene-1,2-diisocyanate; tetramethylene diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)-cyclohexane diisocyanate; 4,4'-bis(isocyanatomethyl) dicyclohexane; 2,4'-bis(isocyanatomethyl) dicyclohexane; isophorone diisocyanate; triisocyanate of HDI; triisocyanate of 2,2,4-trimethyl-1,6-hexane diisocyanate; 4,4' dicyclohexylmethane diisocyanate; 2,4-hexahydrotoluene diisocyanate; 2,6-hexahydrotoluene diisocyanate; and mixtures thereof. Aromatic aliphatic isocyanates may also be used to form light stable materials. Examples of such isocyanates include 1,2-, 1,3-, and 1,4-xylene diisocyanate; meta-tetramethylxylene diisocyanate; p-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof. In addition, the aromatic aliphatic isocyanates may be mixed with any of the saturated isocyanates listed above for the purposes of this invention.

The number of unreacted NCO groups in the polyurea prepolymer of isocyanate and polyether amine may be varied to control such factors as the speed of the reaction, the resultant hardness of the composition, and the like. For example, the number of unreacted NCO groups in the polyurea prepolymer of isocyanate and polyether amine may be less than about 14%. In one embodiment, the polyurea prepolymer has from about 5% to 11% unreacted NCO groups, preferably from about 6% to 9.5% unreacted NCO groups. In one embodiment, the percentage of unreacted NCO groups is about 3% to 9%. Alternatively, the percentage of unreacted NCO groups in the polyurea prepolymer may be about 7.5% or less, more preferably, about 7% or less. In another embodiment, the unreacted NCO content is from about 2.5% to 7.5%, more preferably from about 4% to 6.5%.

When formed, polyurea prepolymers may contain about 10% to 20% by weight of the prepolymer of free isocyanate monomer. Thus, in one embodiment, the polyurea prepolymer may be stripped of the free isocyanate monomer. For example, after stripping, the prepolymer may contain about 1% or less free isocyanate monomer. In another embodiment, the prepolymer contains about 0.5% by weight or less of free isocyanate monomer.

The polyether amine may be blended with additional polyols to formulate copolymers that are reacted with excess isocyanate to form the polyurea prepolymer. In one embodiment, less than about 30% polyol by weight of the copolymer is blended with the saturated polyether amine. In another embodiment, less than about 20% polyol by weight of the copolymer, preferably less than about 15% by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking the polyurea prepolymer with a single curing agent or a blend of curing agents. The curing agent of the invention is preferably an amine-terminated curing agent, more preferably a secondary diamine curing agent so that the composition contains only urea linkages. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5;dimethylthio-2,4-toluenediamine; 3,5-dimethylthio-2,6-toluenediamine; 3,5-diethylthio-2,4-toluenediamine; 3,5-diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis (2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); m-phenylenediamine; paraphenylenediamine; and mixtures thereof. In one embodiment, the amine-terminated curing agent is 4,4'-bis-(sec-butylamino)-dicyclohexylmethane.

Suitable saturated amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 4,4'-methylenebis-(2,6-diethylaminocyclohexane; 1,4-cyclohexane-bis-(methylamine); 1,3-cyclohexane-bis-(methylamine); diethylene glycol di-(aminopropyl)ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; imido-bis-propylamine; monoethanolamine, diethanolamine; triethanolamine; monoisopropanolamine, diisopropanolamine; isophoronediamine; triisopropanolamine; and mixtures thereof. In addition, any of the polyether amines listed above may be used as curing agents to react with the polyurea prepolymers.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogenous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Due to the very thin nature, it has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

Cover compositions may include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

The cover preferably has a surface hardness of 70 Shore D or less, or 65 Shore D or less, or 60 Shore D or less, or 55 Shore D or less. The cover preferably has a material hardness of 70 Shore D or less, or 65 Shore D or less, or 60 Shore D or less, or 55 Shore D or less. Alternatively, the cover preferably has a surface hardness of 60 Shore D or greater, or 65 Shore D or greater. The cover preferably has a material hardness of 60 Shore D or greater, or 65 Shore D or greater.

In a particular embodiment, the cover is a dual- or multi-layer cover including an inner or intermediate cover layer formed from a composition of the present invention and an outer cover layer formed from a polyurethane- or polyurea-based composition. The inner cover layer preferably has a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer is preferably formed from a castable or reaction injection moldable polyurethane, polyurea, or copolymer or hybrid of polyurethane/polyurea. Such cover material is preferably thermosetting, but may be thermoplastic. The outer cover layer composition preferably has a material hardness of 85 Shore C or less, or 45 Shore D or less, or 40 Shore D or less, or from 25 Shore D to 40 Shore D, or from 30 Shore D to 40 Shore D. The outer cover layer preferably has a surface hardness within a range having a lower limit of 20 or 30 or 35 or 40 Shore D and an upper limit of 52 or 58 or 60 or 65 or 70 or 72 or 75 Shore D. The outer cover layer preferably has a thickness within a range having a lower limit of 0.01 or 0.015 or 0.025 inches and an upper limit of 0.035 or 0.04 or 0.045 or 0.05 or 0.055 or 0.075 or 0.08 or 0.115 inches.

A moisture vapor barrier layer is optionally employed between the core and the cover. Moisture vapor barrier layers are further disclosed, for example, in U.S. Pat. Nos. 6,632,147; and 7,182,702, the entire disclosures of which are hereby incorporated herein by reference.

In addition to the materials disclosed above, any of the core or cover layers may comprise one or more of the following materials as long as they are not used at such a level as to negatively affect thermal stability of the blend, increase melt flow beyond a critical level, or otherwise work against the inventive objective disclosed herein: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, styrene-acrylonitrile ("SAN"), olefin-modified SAN, acrylonitrile-styrene-acrylonitrile, styrene-maleic anhydride ("S/MA") polymer, styrenic copolymer, functionalized styrenic copolymer, functionalized styrenic terpolymer, styrenic terpolymer, cellulose polymer, liquid crystal polymer ("LCP"), ethylene-propylene-diene rubber ("EPDM"), ethylene-vinyl acetate copolymer ("EVA"), ethylene propylene rubber ("EPR"), ethylene vinyl acetate, polyurea, and polysiloxane. Suitable polyamides for use as an additional material in compositions disclosed herein also include resins obtained by: (1) polycondensation of (a) a dicarboxylic acid, such as oxalic acid, adipic acid, sebacic acid, terephthalic acid, isophthalic acid or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine or m-xylylenediamine; (2) a ring-opening polymerization of cyclic lactam, such as .epsilon.-caprolactam or co-laurolactam; (3) polycondensation of an aminocarboxylic acid, such as 6-aminocaproic acid, 9-aminononanoic acid, 11-aminoundecanoic acid or 12-aminododecanoic acid; or (4) copolymerzation of a cyclic lactam with a dicarboxylic acid and a diamine. Specific examples of suitable polyamides include NYLON 6, NYLON 66, NYLON 610, NYLON 11, NYLON 12, copolymerized NYLON, NYLON MXD6, and NYLON 46.

Other preferred materials suitable for use as an additional material in golf ball compositions disclosed herein include SKYPEL polyester elastomers from SK Chemicals of South Korea; SEPTON diblock and triblock copolymers from Kuraray Corporation of Kurashiki, Japan; and KRATON diblock and triblock copolymers from Kraton Polymers of Houston, Tex.

Ionomers are also well suited for blending with compositions disclosed herein. Suitable ionomeric polymers include .alpha.-olefin/unsaturated carboxylic acid copolymer- or terpolymer-type ionomeric resins. Copolymeric ionomers are obtained by neutralizing at least a portion of the carboxylic groups in a copolymer of an .alpha.-olefin and an .alpha.,.beta.-unsaturated carboxylic acid having from 3 to 8 carbon atoms, with a metal ion. Terpolymeric ionomers are obtained by neutralizing at least a portion of the carboxylic groups in a terpolymer of an .alpha.-olefin, an .alpha.,.beta.-unsaturated carboxylic acid having from 3 to 8 carbon atoms, and an .alpha.,.beta.-unsaturated carboxylate having from 2 to 22 carbon atoms, with a metal ion. Examples of suitable .alpha.-olefins for copolymeric and terpolymeric ionomers include ethylene, propylene, 1-butene, and 1-hexene. Examples of suitable unsaturated carboxylic acids for copolymeric and terpolymeric ionomers include acrylic, methacrylic, ethacrylic, .alpha.-chloroacrylic, crotonic, maleic, fumaric, and itaconic acid. Copolymeric and terpolymeric ionomers include ionomers having varied acid contents and degrees of acid neutralization, neutralized by monovalent or bivalent cations as disclosed herein.

Silicone materials are also well suited for blending with compositions disclosed herein. Suitable silicone materials include monomers, oligomers, prepolymers, and polymers, with or without adding reinforcing filler. One type of silicone material that is suitable can incorporate at least one alkenyl group having at least 2 carbon atoms in their molecules. Examples of these alkenyl groups include, but are not limited to, vinyl, allyl, butenyl, pentenyl, hexenyl, and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl, and xylyl; aralkyl groups, such as benzyl and phenethyl; and halogenated alkyl groups, such as 3,3,3-trifluoropropyl and chloromethyl. Another type of suitable silicone material is one having hydrocarbon groups that lack aliphatic unsaturation. Specific examples include: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxyl-endblocked methylphenylsiloxane-dimethylsiloxane-methylvinysiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and the copolymers listed above wherein at least one group is dimethylhydroxysiloxy. Examples of commercially-available silicones suitable for blending with compositions disclosed herein include SILASTIC®. silicone rubber from Dow Corning Corporation of Midland, Mich.; BLENSIL® silicone rubber from GE of Waterford, N.Y.; and ELASTOSIL® silicones from Wacker Chemie AG of Germany.

Other types of copolymers can also be added to the golf ball compositions disclosed herein. For example, suitable copolymers comprising epoxy monomers include styrene-butadiene-styrene block copolymers in which the polybutadiene block contains an epoxy group, and styrene-isoprene-styrene block copolymers in which the polyisoprene block contains epoxy. Examples of commercially-available epoxy functionalized copolymers include ESBS A1005, ESBS A1010, ESBS A1020, ESBS AT018, and ESBS AT019 epoxidized styrene-butadiene-styrene block copolymers from Daicel Chemical Industries of Japan.

Ionomeric compositions used to form golf ball layers of the present invention can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, PEBAX® thermoplastic polyether block amides from Arkema Inc., styrene-butadiene-styrene block copolymers, styrene(ethylene-butylene)-styrene block copolymers, polyamides, polyesters, polyolefins (e.g., polyethylene, polypropylene, ethylene-propylene copolymers, ethylene-(meth)acrylate, ethylene-(meth)acrylic acid, functionalized polymers with maleic anhydride grafting, epoxidation, etc., elastomers (e.g., EPDM, metallocene-catalyzed polyethylene) and ground powders of the thermoset elastomers.

Compositions disclosed herein can be either foamed or filled with density adjusting materials to provide desirable golf ball performance characteristics.

The present invention is limited to elevated temperature molding due to the very-low-flow nature of the thermoplastic intermediate core layers. It should be understood that while any of the other core and/or cover layer(s) can be formed by any suitable technique, including injection molding, compression molding, casting, and reaction injection molding, the thermoplastic inner cover layers are generally formed by injection molding or compression molding. In particular, the core center and outer core layers may be formed by any conventional means for forming thermosetting layers comprising a vulcanized or otherwise crosslinked diene rubber including, but not limited to, compression molding, rubber-injection molding, casting of a liquid rubber, and laminating.

When the thermoplastic inner cover layers are formed with injection molding, the composition is typically in a pelletized or granulated form that can be fed into the throat of an injection molding machine where it is melted and conveyed via a screw in a heated barrel at temperatures of from 400° F. (204° C.) to 680° F. (360° C.), preferably from 520° F. (271° C.) to 650° F. (343° C.). The molding temperatures are significantly higher temperatures than typically used for conventional injection molding of ionomeric materials.

The molten composition is ultimately injected into a closed mold cavity, which may be cooled, at ambient or at an elevated temperature, but typically the mold is cooled to a temperature of from 50° F. (10° C.) to 70° F. (21° C.). After residing in the closed mold for a time of about 1 to 300 seconds, preferably about 20 to 120 seconds, the core and/or core plus one or more additional core or cover layers is removed from the mold and either allowed to cool at ambient or reduced temperatures or is placed in a cooling fluid such as water, ice water, dry ice in a solvent, or the like.

When compression molding is used to form a core center or outer core layer, the composition is first formed into a preform or slug of material, typically cylindrically-shaped or roughly spherical-shaped, at a weight slightly greater than the desired weight. Prior to this step, the composition may be first extruded or otherwise melted and forced through a die after which it is cut into the preform. The preform is then placed into a compression mold cavity and compressed at a mold temperature of from 150° F. (66° C.) to 400° F. (204° C.), preferably from 250° F. (121° C.) to 400° F. (204° C.), and more preferably from 300° F. (149° C.) to 400° F. (204° C.). When compression molding a cover layer, half-shells of the cover layer material are first formed via injection molding. A core is then enclosed within two half-shells, which is then placed into a compression mold cavity and compressed.

Reaction injection molding processes are further disclosed, for example, in U.S. Pat. Nos. 6,083,119, 7,208,562, 7,281,997, 7,282,169, and 7,338,391, the entire disclosures of which are hereby incorporated herein by reference.

Golf balls of the present invention typically have a coefficient of restitution of 0.700 or greater, preferably 0.750 or greater, and more preferably 0.780 or greater. Golf balls of the present invention typically have a compression of 40 or greater, or a compression within a range having a lower limit of 50 or 60 and an upper limit of 100 or 120. Golf balls of the present invention will typically have dimple coverage of 60% or greater, preferably 65% or greater, and more preferably 75% or greater.

The USGA specifications limit the minimum size of a competition golf ball to 1.68 inches. There is no specification as to the maximum diameter and golf balls of any size can be used for recreational play. Golf balls of the present invention can have an outer diameter of any size. The preferred outer diameter is within a range having a lower limit of 1.680 inches and an upper limit of 1.740 or 1.760 or 1.780 or 1.800 inches.

Golf balls of the present invention preferably have a moment of inertia ("MOI") of about 70 to 95 $gcm^2$, preferably about 75 to 93 $gcm^2$, and more preferably about 76 to 90 $gcm^2$. For low MOI embodiments, the golf ball preferably has an MOI of 85 $gcm^2$ or less, or 83 $gcm^2$ or less. For high MOI embodiment, the golf ball preferably has an MOI of 86 $gcm^2$ or greater, or 87 $gcm^2$ or greater. MOI is measured on a model MOI-005-104 Moment of Inertia Instrument manufactured by Inertia Dynamics of Collinsville, Conn.

Compression is an important factor in golf ball design. For example, the compression of the core can affect the ball's spin rate off the driver and the feel. As disclosed in "Compression by Any Other Name," Science and Golf IV, Proceedings of the World Scientific Congress of Golf (Eric Thain ed., Routledge, 2002) by J. Dalton, several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in the Dalton article.

COR, as used herein, is determined according to a procedure where a golf ball or golf ball subassembly (e.g., a core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V(out)/V(in)=T(in)/T(out)$.

The surface hardness of a golf ball layer is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within .+−.0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180. degree. apart, or 90. degree. apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer. Hardness points should only be measured once at any particular geometric location.

For purposes of the present disclosure, a hardness gradient of a center is defined by hardness measurements made at the outer surface of the center and the center point of the core. "Negative" and "positive" refer to the result of subtracting the hardness value at the innermost portion of the golf ball component from the hardness value at the outer surface of the component. For example, if the outer surface of a solid center has a lower hardness value than the center (i.e., the surface is softer than the center), the hardness gradient will be deemed a "negative" gradient. In measuring the hardness gradient of a center, the center hardness is first determined according to the procedure above for obtaining the center hardness of a core. Once the center of the core is marked and the hardness thereof is determined, hardness measurements at any distance from the center of the core may be measured by drawing a line radially outward from the center mark, and measuring and marking the distance from the center, typically in 2 mm increments. All hardness measurements performed on a plane passing through the geometric center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point, e.g., at the center of the core for a single, solid core, such that a core surface softer than its center will have a negative hardness gradient.

Hardness gradients are disclosed more fully, for example, in U.S. Pat. No. 7,429,221, and U.S. patent application Ser. Nos. 11/939,632; 11/939,634; 11/939,635; and Ser. No. 11/939,637; the entire disclosure of each are hereby incorporated herein by reference.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

When numerical lower limits and numerical upper limits are set forth herein, it is contemplated that any combination of these values may be used. All patents, publications, test procedures, and other references cited herein, including priority documents, are fully incorporated by reference to the extent such disclosure is not inconsistent with this invention.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising:

a core;

an inner cover layer comprising a first thermoplastic composition and having a thickness of about 0.005 inches to about 0.40 inches and a surface hardness of about 70 Shore D or less; and an outer cover layer comprising a thermoplastic polyurethane and having a thickness of about 0.01 inches to about 0.075 inches and a surface hardness of about 20 Shore D to about 60 Shore D;

wherein the first thermoplastic composition comprises a first melt flow index at 280° C. under a 10-kg load of less than about 35 g/10 min and a second melt flow index at 265° C. under a 5-kg load of less than about 10 g/10 min.

2. The golf ball of claim 1, wherein the first melt flow index is about 20 g/10 min or less.

3. The golf ball of claim 2, wherein the first melt flow index is about 10 g/10 min or less.

4. The golf ball of claim 3, wherein the second melt flow index is about 5 g/10 min or less.

5. The golf ball of claim 1, wherein the first thermoplastic composition has a third melt flow index at 190° C. under a 2.16-kg load of less than about 2 g/10 min.

6. The golf ball of claim 5, wherein the third melt flow index at is less than about 1 g/10 min.

7. The golf ball of claim 1, wherein the first thermoplastic composition comprises an ionomer.

8. The golf ball of claim 7, wherein the first thermoplastic composition comprises a higher-melting-temperature thermoplastic resin.

9. The golf ball of claim 7, wherein the first thermoplastic composition comprises a reactive polymer.

10. The golf ball of claim 7, wherein the ionomer is neutralized by a metal cation to 80 wt % or greater.

11. The golf ball of claim 10, wherein the ionomer is neutralized by a metal cation to 90 wt % or greater.

12. The golf ball of claim 1, wherein the first thermoplastic composition comprises an amine or a peroxide compound.

13. The golf ball of claim 1, wherein the core comprises an inner core and an outer core layer.

14. A golf ball comprising:

a core;

an inner cover layer comprising a first thermoplastic composition and having a thickness of about 0.005 inches to about 0.40 inches and a surface hardness of about 70 Shore D or less; and an outer cover layer comprising a second thermoplastic material and having a thickness of about 0.01 inches to about 0.075 inches and a surface hardness of about 20 Shore D to about 60 Shore D;

wherein the first thermoplastic composition comprises a first melt flow index at 280° C. under a 10-kg load of less than about 35 g/10 min and a second melt flow index at 265° C. under a 5-kg load of less than about 10 g/10 min.

15. The golf ball of claim 14, wherein the second thermoplastic composition comprises a thermoplastic polyurethane.

16. The golf ball of claim 14, wherein the core comprises an inner core and an outer core layer.

* * * * *